United States Patent [19]

Raveggi

[11] Patent Number: 4,572,066

[45] Date of Patent: Feb. 25, 1986

[54] APPARATUS FOR APPLYING A LENGTHENING ROD AND FOR REEL PRESSING IN CONNECTION WITH A DYEING BASKET FOR YARN REELS

[75] Inventor: Ornella Raveggi, Montecatini Terme, Italy

[73] Assignee: Officine Minnetti Di Federico Minnetti & C.S.A.S., Pieve A Nievole (Pistoria), Italy

[21] Appl. No.: 638,499

[22] Filed: Aug. 7, 1984

[30] Foreign Application Priority Data

Oct. 6, 1983 [IT] Italy ..... 23176 A/83

[51] Int. Cl.[4] ..... B30B 15/06

[52] U.S. Cl. ..... 100/295; 8/155; 68/189; 414/27

[58] Field of Search ..... 100/295; 29/241, 433; 414/27; 8/155; 68/189, 198, 210

[56] References Cited

U.S. PATENT DOCUMENTS 3,604,346 9/1971 Caire ..... 100/295 X

*Primary Examiner*—Billy J. Wilhite

*Attorney, Agent, or Firm*—Fleit, Jacobson, Cohn & Price

[57] ABSTRACT

An apparatus for applying a lengthening rod and for reel pressing, in connection with loading of spring core reels on each spindle of a dyeing basket or package carrier, wherein the reels (R) are slipped onto said spindle and onto an auxiliary lengthening rod and then pressed to the height of said spindle, comprises gripping means for gripping the lengthening rod, said means including jaws movable between a closed position and an open position, said jaws having gripping seats of suitable shape to grasp said lengthening rod; means for moving said jaws in a direction according to the axis of said spindle; and means for moving said jaws transversely of said direction. The apparatus further comprises a pressing device including pressing tabs.

5 Claims, 4 Drawing Figures

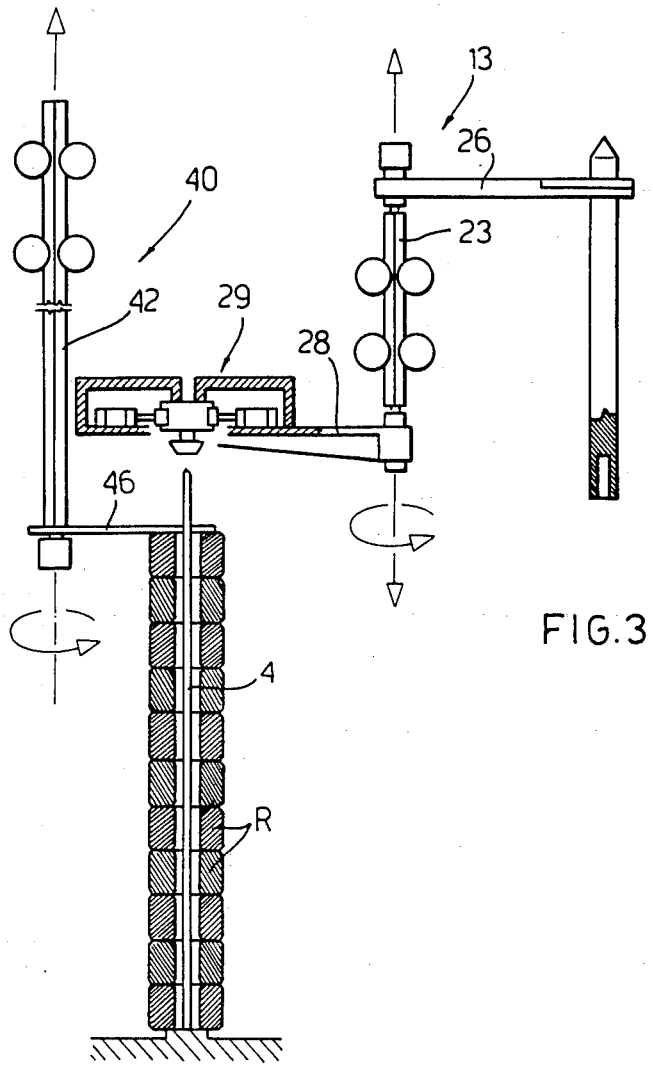
FIG.3
FIG.4
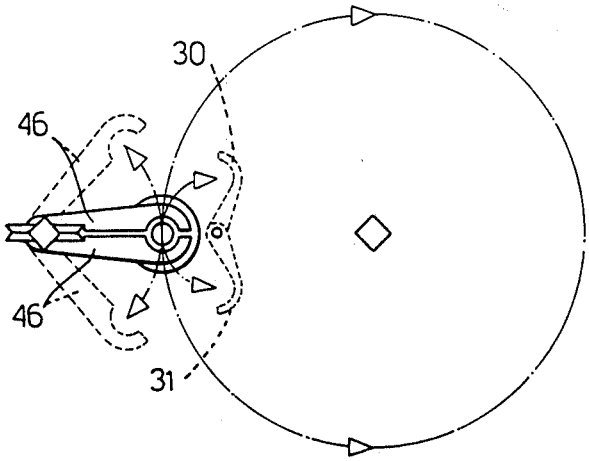

APPARATUS FOR APPLYING A LENGTHENING ROD AND FOR REEL PRESSING IN CONNECTION WITH A DYEING BASKET FOR YARN REELS

This patent application relates to the handling of yarn reels or packages (i.e. frusto-conical or cylindrical yarn windings on a frusto-conical or cylindrical, generally perforated, supporting core). For yarn dyeing, a plurality of reels are slipped onto each spindle of a dyeing basket or package carrier, comprising a plurality of vertically extending spindles. The reels thus slipped onto each spindle are clamped by well known retaining or clamping devices.

In particular systems, reels are at present used which have a compressible spring center or core. With such reels, loading on each reel carrying spindle is carried out as follows. The uncompressed reels are slipped onto the spindle (without any interposition of separating pans or plates) to fill the spindle at nearly complete height. Then, an auxiliary or lengthening rod is applied on the spindle to extend the latter for some height and further reels are slipped onto the lengthening rod. Pressure is applied to the top reel to press all the reels to the height of the spindle (this is allowed by the core resiliency); the lengthening rod is removed while maintaining the pressure, a clamping or blocking device is applied and pressure is released.

The operations for application and removal of the lengthening rod and application of the blocking device are generally manually affected. This has the disadvantage of lack of comfort in application and the drawback of inherent costs, for example labour costs.

It is an object of the present patent application to reduce the costs inherent to such operations and to remove an inconvenient repetitive work.

The above object has been achieved by an apparatus according to the present patent application, that is an apparatus comprising gripping means for gripping a lengthening rod which means includes jaws movable between a closed position and an open position, said jaws having gripping seats of suitable shape to grasp a lengthening rod; and means for moving said jaws in a direction according to the axis of a reel carrying spindle; as well as means for moving said jaws transversely of said direction. Preferably, the apparatus comprises a jaw carrying arm extended from a vertically movable slide on a rotatable structure having a vertical axis, and preferably also comprises a second arm fixed with respect to said first arm and angularly arranged thereto, said second arm carrying a machine for the application of blocking devices on the spindles. The apparatus further comprises a pressing device including pressure tabs, said tabs being of a sufficient width to engage an upper face of a top reel on the rod, said tabs at opposing faces thereof having notches of an area larger than the rod section; said tabs being movable between an open condition in which they do not engage the reels, and a closed condition in which they engage the reels; said tabs being able to be lowered along the rod and the spindle.

The novel apparatus enables application and removal of a lengthening rod, reel clamping and reel pressing in an autonomous and coordinate way.

An unrestrictive exemplary embodiment of the invention will now be described with reference to the accompanying drawings, in which:

FIG. 3 is a side view similar to FIG. 2, showing the apparatus at a next operation step; and FIG. 4 is a schematic plan view showing various positions for the pliers jaws and pressing tabs.

Figure 1:
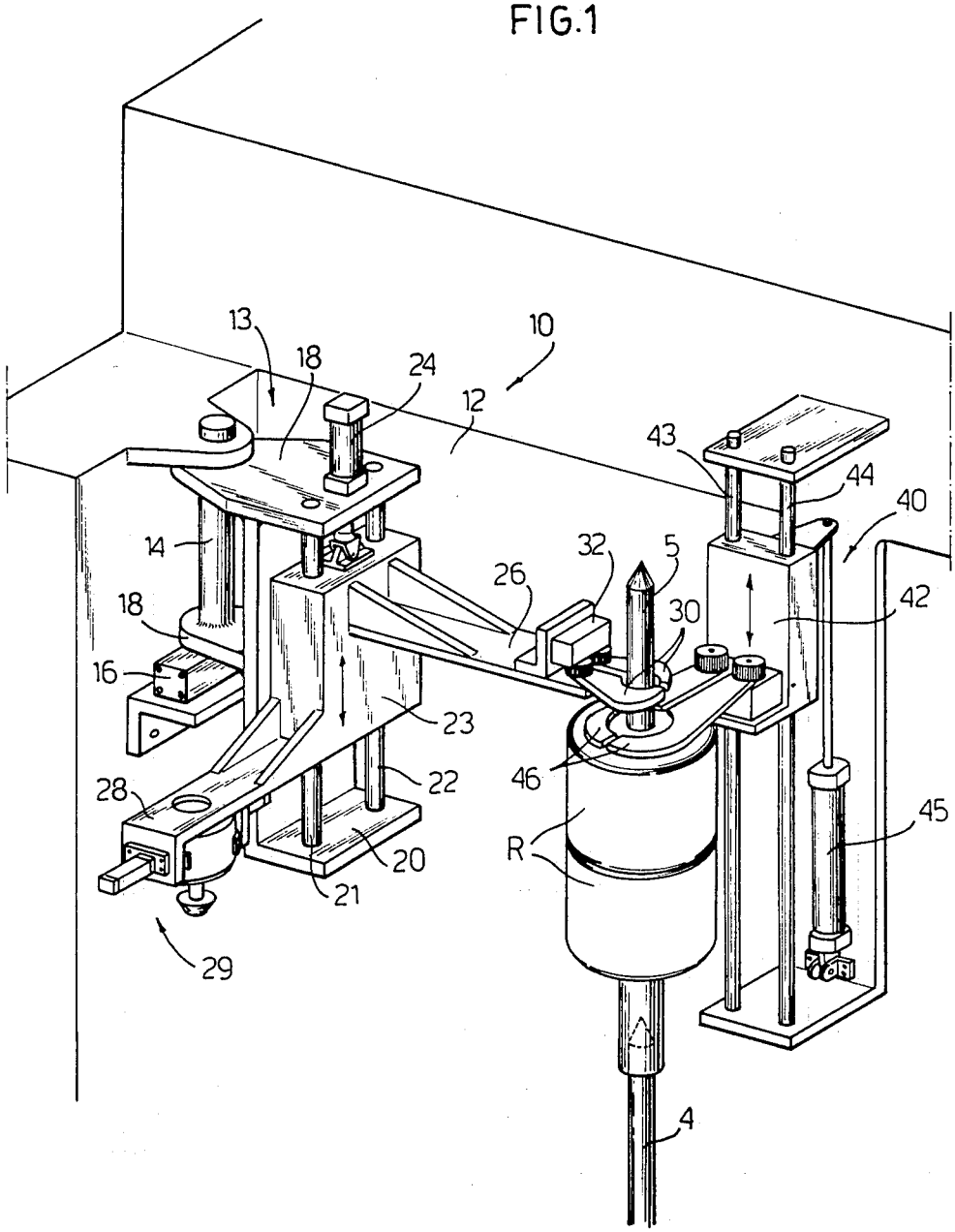
FIG. 1 is a simplified perspective view showing an apparatus according to the invention.
Figure 2:
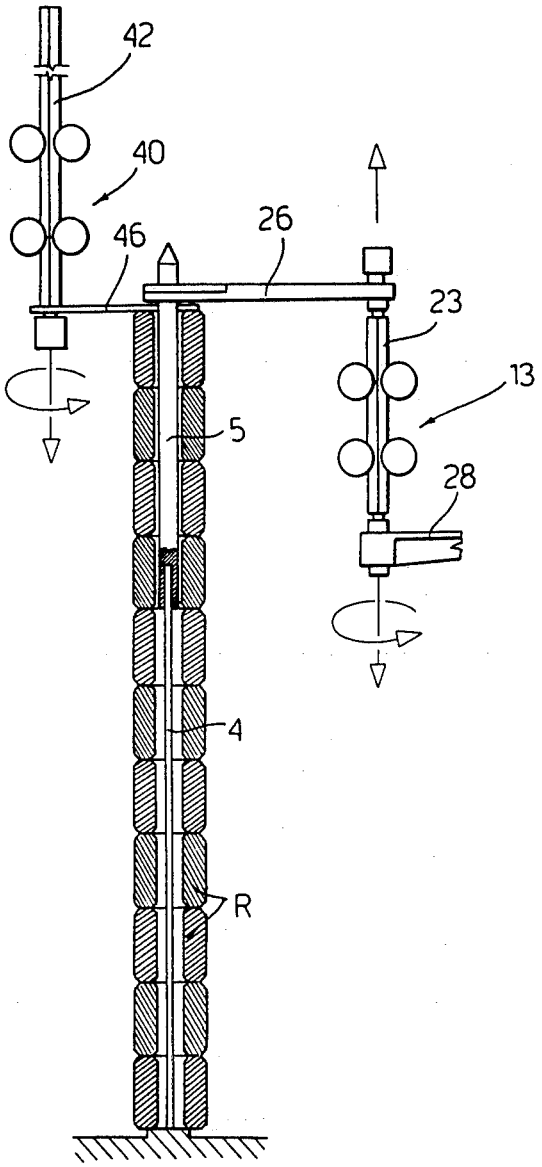
FIG. 2 is a schematic side spread view showing a step in the operation of the apparatus, with the reels shown in sectional view.

Referring first to FIG. 1, reference numeral 4 denotes a rod or spindle of a dyeing basket or package carrier, reference numeral 5 denotes an auxiliary lengthening rod applied to said spindle 4, and R denotes yarn reels having a spring center or core; in the drawing some reels have been removed so that said spindle 4 and auxiliary rod 5 could be shown.

The apparatus as a whole bears reference number 10 and comprises a lengthening rod handling unit 13 on a fixed or stationary framework 12, said unit including a vertical shaft 14 rotatable about its own axis by any known operating means 16, such as a rotary piston. On two brackets 18, said shaft 14 carries a structure 20 having vertical guides 21 and 22, on which a slide 23 is movable under the control of a cylinder-piston assembly 24 or other operating means. This slide 23 carries a pliers holder arm 26, and preferably also a clamping or blocking arm 28 at an angle to said pliers holder arm 26. The latter radially extends relative to the axis of shaft 14 and at an end thereof carries a pair of jaws 30 driven to open and closed conditions by any known means, such as a rotary piston 32 only schematically shown in FIG. 1. Each of said jaws 30 have a gripping notch facing the other jaw, the gripping notches being lined with anti-friction material, such as rubber or rubber-like material. The size and radius of the notches is such that the grasping of lengthening rod 5 is enabled.

Said arm 28 preferably carries a machine or apparatus 29 for application of reel clamping or blocking devices; such an apparatus is the subject of a copending application, Ser. No. 566,695, filed Dec. 29, 1983, of the same applicant and will not be herein described in detail.

A pressing unit 40 is mounted on said framework 12 or other stationary part of the apparatus and comprises a slide 42 movable on vertical guides 43 and 44 under the control of a cylinder-piston assembly 45 or other operating means.

Said slide 42 carries a pair of reel pressing tabs 46, 46. The latter have a substantial width related to the reel radius and a notch in the opposing faces, such notches forming an aperture of a larger area than the cross-section of the lengthening rod 5. Each of said tabs are pivoted for moving between an open position (shown by dashed lines in FIG. 4) in which they do not engage the reels and a closed position (shown in FIG. 1 and by full line in FIG. 4) about the rod or spindle, in the latter position the tabs engaging the reels.

At closed position, said tabs apply pressure onto the stacked reels R under the control of the cylinder-piston assembly 42.

The operative cycle occurs as it will be discussed in the following.

A reel carrying spindle 4 is filled with reels R to nearly full height by any known means. At this step, arms 26 and 28 are moved away from the spindle, and arm 26 grips a lengthening rod 5 by the jaws 30. Then, structure 18 is rotated to bring said jaws 30 with said rod 5 in alignment on spindle 4 (preferably, per se known positioning means are provided), and said rod 5 is lowered seating it on spindle 4. The jaws 30 open to allow further reels to slip onto the lengthening rod until the latter is filled up. Now, said jaws 30 are lifted and close again on the upper end of the lengthening rod, while said tabs 46 close under said jaws 30 and start to lower, pressing the reels.

When the pressing has lowered the reels under the lower end of the lengthening rod 5, the latter is drawn by jaws 30 and structure 20 is rotated to move the lengthening rod away and bring the blocking device applying machine on the vertical spindle 4, while said tabs 46 will continue to hold the reels R under pressed condition, but without further lowering. Then, clamping is carried out and said tabs 46 open and move back to the cycle start position, while another spindle is presented to filling operation. Of course, modifications can be made to the foregoing. For example, the clamping arm 28 and relative apparatus could be omitted or be mounted independently of arm 26. The assembly of arm 26 and possible arm 28 may be different from the embodiment shown, provided that a movement is allowed in a direction substantially parallel to the spindle axis and another movement or displacement is allowed transversely of said first one.

What I claim is:

1. An applying and/or removing apparatus for applying and/or removing a lengthening rod on a spindle of a dyeing basket, on which spindle and rod yarn reels having a compressible core are applied forming a pile and then pressed to the height of said spindle, said apparatus comprising gripping means for gripping the lengthening rod, said gripping means including jaws movable between closed and open positions, said jaws having gripping seats of suitable shape to grip said lengthening rod; and means for moving said jaws in a direction parallel to the axis of said spindle.

2. An apparatus as claimed in claim 1, further comprising means for moving said jaws transversely of said direction parallel to the axis of said spindle.

3. An apparatus as claimed in claim 2, further comprising a structure rotating about a vertical axis, a slide vertically movable on said structure, and a first jaw holder arm extended from said slide.

4. An apparatus as claimed in claim 3, further comprising a second arm fixed to said first arm at an angle thereto, said second arm carrying an apparatus for application of a reel clamping device on the spindle.

5. An apparatus as claimed in claim 1, further comprising a pressing unit, said pressing unit including pressing tabs, said tabs being of a substantial width to engage an upper face of a top reel and having opposing faces formed with notches of larger area than the cross-sectional area of the lengthening rod, said tabs being movable between an open condition and a closed condition, said tabs in said open condition being out of engagement with a pile of reels carried onto said spindle, said tabs in said closed condition being able to engage the top reel of said pile of reels, and said pressing unit further comprising means to lower said pressing tabs in said closed condition along said lengthening rod.

* * * * *